US006966150B2

(12) United States Patent
Chiang

(10) Patent No.: US 6,966,150 B2
(45) Date of Patent: Nov. 22, 2005

(54) ADJUSTABLE AUTOMATIC POSITIONING HINGE FOR GLASS DOORS

(76) Inventor: Fanny Chiang, 11 Fl.-4, No. 16, Chungming S. Rd. West District, Taichung (TW)

( * ) Notice: Subject to any disclaimer, the term of this patent is extended or adjusted under 35 U.S.C. 154(b) by 28 days.

(21) Appl. No.: 10/843,567

(22) Filed: May 12, 2004

(65) Prior Publication Data

US 2004/0206007 A1 Oct. 21, 2004

Related U.S. Application Data

(63) Continuation-in-part of application No. 10/411,231, filed on Apr. 11, 2003, now Pat. No. 6,826,870.

(51) Int. Cl.[7] ..... E05D 7/08

(52) U.S. Cl. ..... 49/388; 016/252

(58) Field of Search ..... 049/388, 397, 049/399; 016/252, 334, 335; 052/204.58, 052/204.53, 204.54, 204.62, 204.65, 656.2, 052/656.4, 235, 656.9, 213

(56) References Cited

U.S. PATENT DOCUMENTS

| | | | | |
|---|---|---|---|---|
| 5,867,869 | A * | 2/1999 | Garrett et al. | 16/252 |
| 6,070,294 | A * | 6/2000 | Perkins et al. | 16/252 |
| 6,481,055 | B2 * | 11/2002 | Cheng | 16/252 |
| 6,519,811 | B1 * | 2/2003 | Cheng | 16/252 |
| 6,526,627 | B2 * | 3/2003 | Chiang | 16/284 |
| 6,826,870 | B2 * | 12/2004 | Chiang | 49/388 |

* cited by examiner

*Primary Examiner*—Jerry Redman
(74) *Attorney, Agent, or Firm*—Fei-Fei Chao; Bingham McCutchen LLP

(57) ABSTRACT

An adjustable automatic positioning hinge for a glass door includes a doorframe mount, a body, a spindle, a positioning device, a door bracket and two adjusting screws. The body is attached to the doorframe mount and rotatably holds the spindle. The spindle has an exterior surface and two inclined adjusting flats defined in the exterior surface. The positioning device is mounted in the body to position the spindle. The door bracket holds the spindle and clamps a glass panel. The adjusting screws are mounted in the door bracket and respectively have an inside end abutting the corresponding inclined adjusting flat. Consequently, the adjustable hinge is simple, and small adjustments can be made to align the glass panel with a doorframe of the glass door.

14 Claims, 10 Drawing Sheets

ADJUSTABLE AUTOMATIC POSITIONING HINGE FOR GLASS DOORS

CROSS REFERENCE TO RELATED APPLICATIONS

This application is a continuation-in-part (CIP) application of U.S. patent application Ser. No. 10/411,231, filed on Apr. 11, 2003 now U.S. Pat. No. 6,826,870.

BACKGROUND OF THE INVENTION

1. Field of the Invention

The present invention relates to an automatic positioning hinge for doors, and more particularly to an adjustable automatic positioning hinge for a glass door in a doorway system.

2. Description of Related Art

A glass door in a doorway system comprises a glass panel, a doorframe and two conventional hinges. The glass panel is pivotally mounted in the doorframe with the hinges. However, exact alignment of the glass panel with the doorframe is important for the glass door. The glass door will not close completely when the glass panel is not aligned exactly with the doorframe.

However, accurately installing the glass panel in the doorframe with the hinges is difficult because the glass panel is generally bulky and heavy to increase security and strength. The glass panel may not be exactly aligned with the doorframe, and small adjustments will be needed to align the glass panel exactly with the doorframe. Conventional hinges in accordance with prior art for glass doors are complex to assemble and cannot be adjusted to align the glass panel with the doorframe after the glass panel has been mounted on the doorframe.

Therefore, installing the glass panel in the doorframe with conventional hinges requires talent and experience or repeated assembly, disassembly and reassembly to ensure the exact alignment of the glass panel with the doorframe. Installation of the glass door with the conventional hinges is inconvenient, slow and costly.

To overcome the shortcomings, the present invention provides an adjustable automatic positioning hinge for a glass door to mitigate or obviate the aforementioned problems.

SUMMARY OF THE INVENTION

The main objective of the invention is to provide a simple adjustable automatic positioning hinge for a glass door comprised of a glass panel, a doorframe and multiple hinges, which can make small adjustments to align the glass panel with the doorframe.

The adjustable automatic positioning hinge for a glass door in accordance with the present invention includes a doorframe mount, a body, a spindle, a positioning device, a door bracket and adjusting screws. The body is securely attached to the doorframe mount and rotatably holds the spindle. The spindle has an exterior surface and two inclined adjusting flats defined in the exterior surface. The positioning device is mounted in the body to apply a restitution force to the spindle to return the glass panel to or hold the glass panel in a closed position. The door bracket holds the spindle and clamps onto the glass panel. The adjusting screws are mounted in the door bracket and have inside ends respectively abutting the inclined adjusting flats. Consequently, the adjustable hinge is simple, and small adjustments can be made to align the glass panel with the doorframe of the glass door by screwing or unscrewing the adjusting screws when the glass panel is not exactly aligned.

Other objectives, advantages and novel features of the invention will become more apparent from the following detailed description when taken in conjunction with the accompanying drawings.

DETAILED DESCRIPTION OF PREFERRED EMBODIMENT

Figure 1:
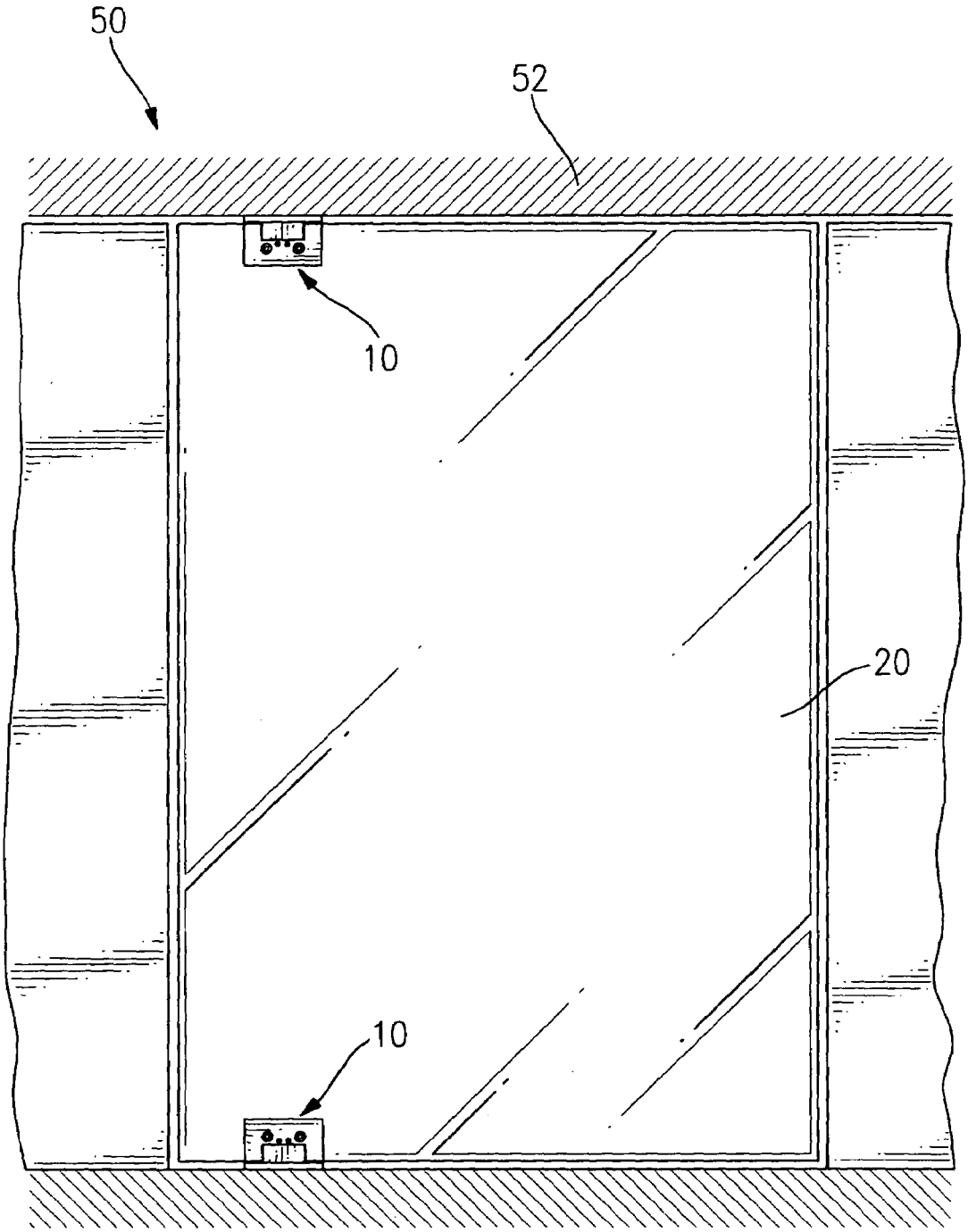
FIG. 1 is a front elevational view of a glass door with a first embodiment of adjustable hinges in accordance with the present invention.
Figure 6:
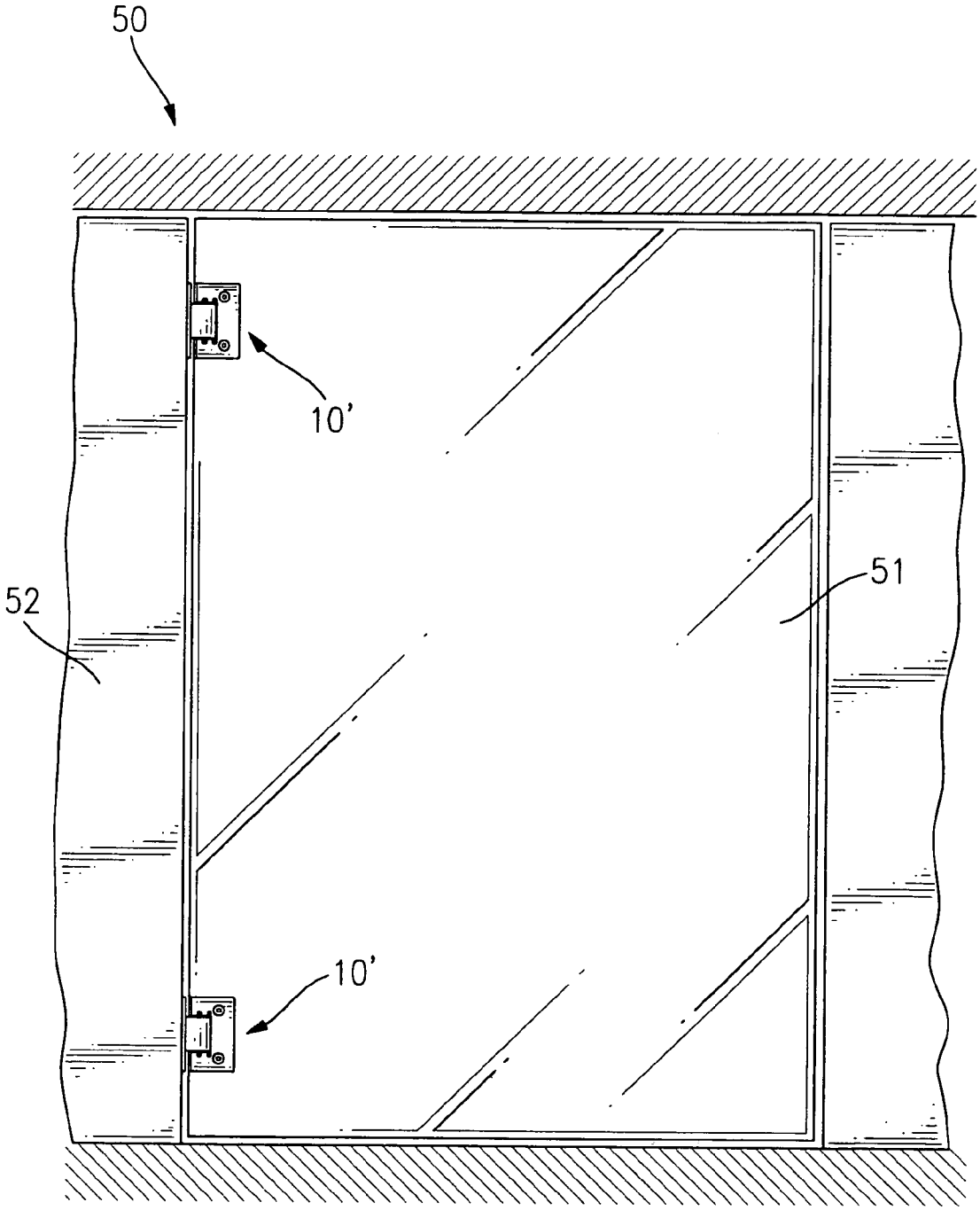
FIG. 6 is a front elevational view of a glass door with a second embodiment of adjustable hinges in accordance with the present invention.

With reference to FIGS. 1 and 6, a glass door (50) includes a glass panel (51) and a doorframe (52) and must have at least two hinges (10, 10') to mount the glass panel (51) pivotally in the doorframe (52). The glass panel (51) has a top edge (not numbered), a bottom edge (not numbered) and two opposite sides (not numbered). The glass panel (51) can be installed in the doorframe (52) with the hinges (10, 10') in two configurations. One configuration has the hinges (10) respectively attached to the top and the bottom edges of the glass panel (51) so the hinges (10) will hold the glass panel (51) pivotally in the doorframe (52). The other configuration has the hinges (10') attached to one of the sides of the glass panel (51) so the hinges (10') will hold the glass panel (51) pivotally in the doorframe (52).

Figure 2:
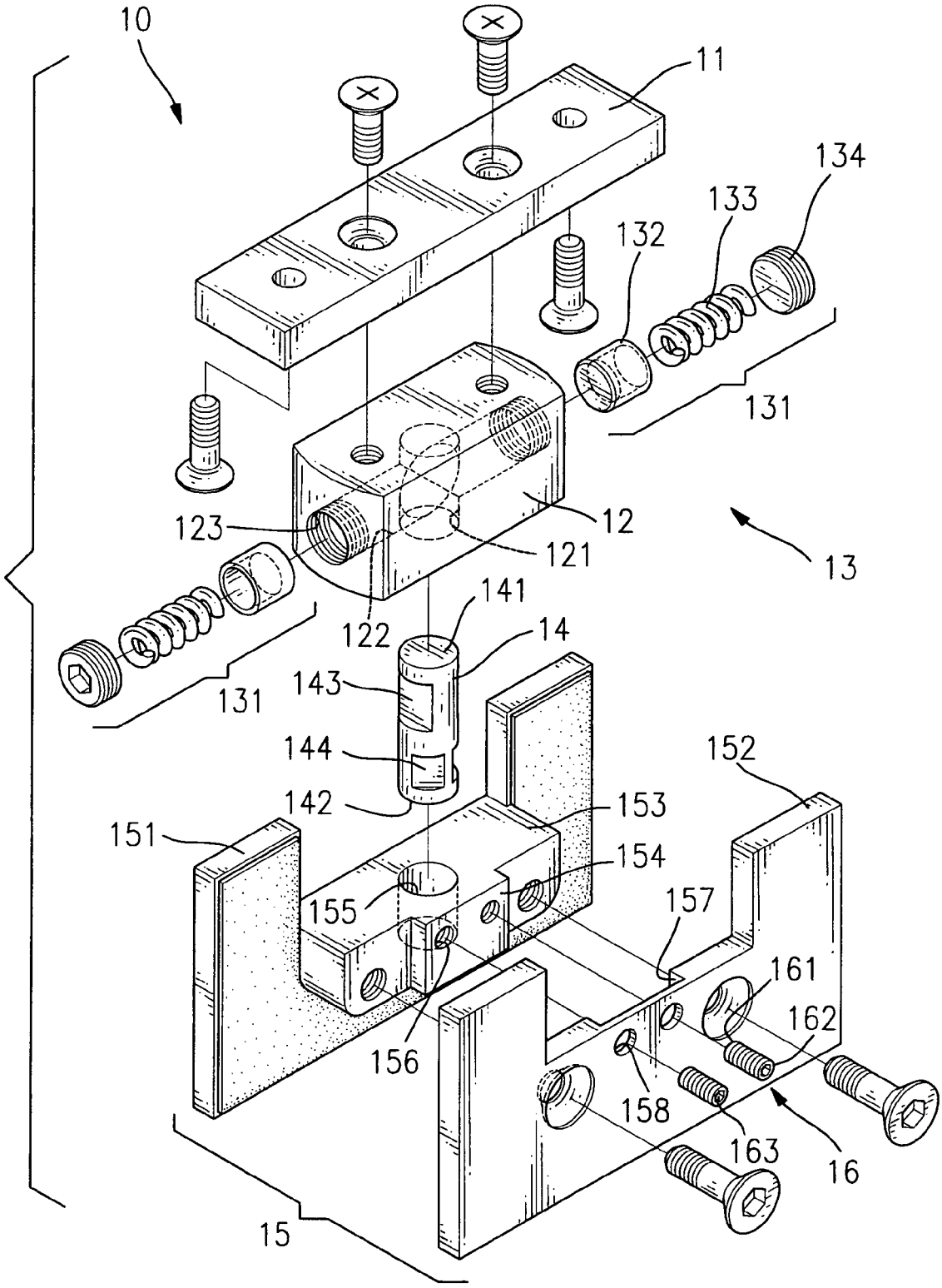
FIG. 2 is an exploded perspective view of an adjustable hinge in FIG. 1.

With reference to FIGS. 1 and 2, a first embodiment of an adjustable hinge (10) in accordance with the present invention mounts a glass panel (51) in a doorframe (52) by attaching the adjustable hinges (10) respectively to the top and bottom edges of the glass panel (51). The first embodiment of the adjustable hinge (10) comprises a doorframe mount (11), a body (12), a positioning device (13), a spindle (14), a door bracket (15) and two adjusting screws (16).

The doorframe mount (11) attaches the adjustable hinge (10) to the doorframe (52). The body (12) is attached to the doorframe mount (11) and has a spindle positioning hole (121) and two transverse holes (122). The spindle positioning hole (121) is defined vertically in the body (12) and faces inward toward the glass panel (51). The transverse holes (122) are defined coaxially in the body (12) and intersect and communicate with the spindle positioning hole (121). Each of the transverse holes (122) has an outside opening (not numbered) and an interior thread (123) defined in the outside opening.

Figure 3:
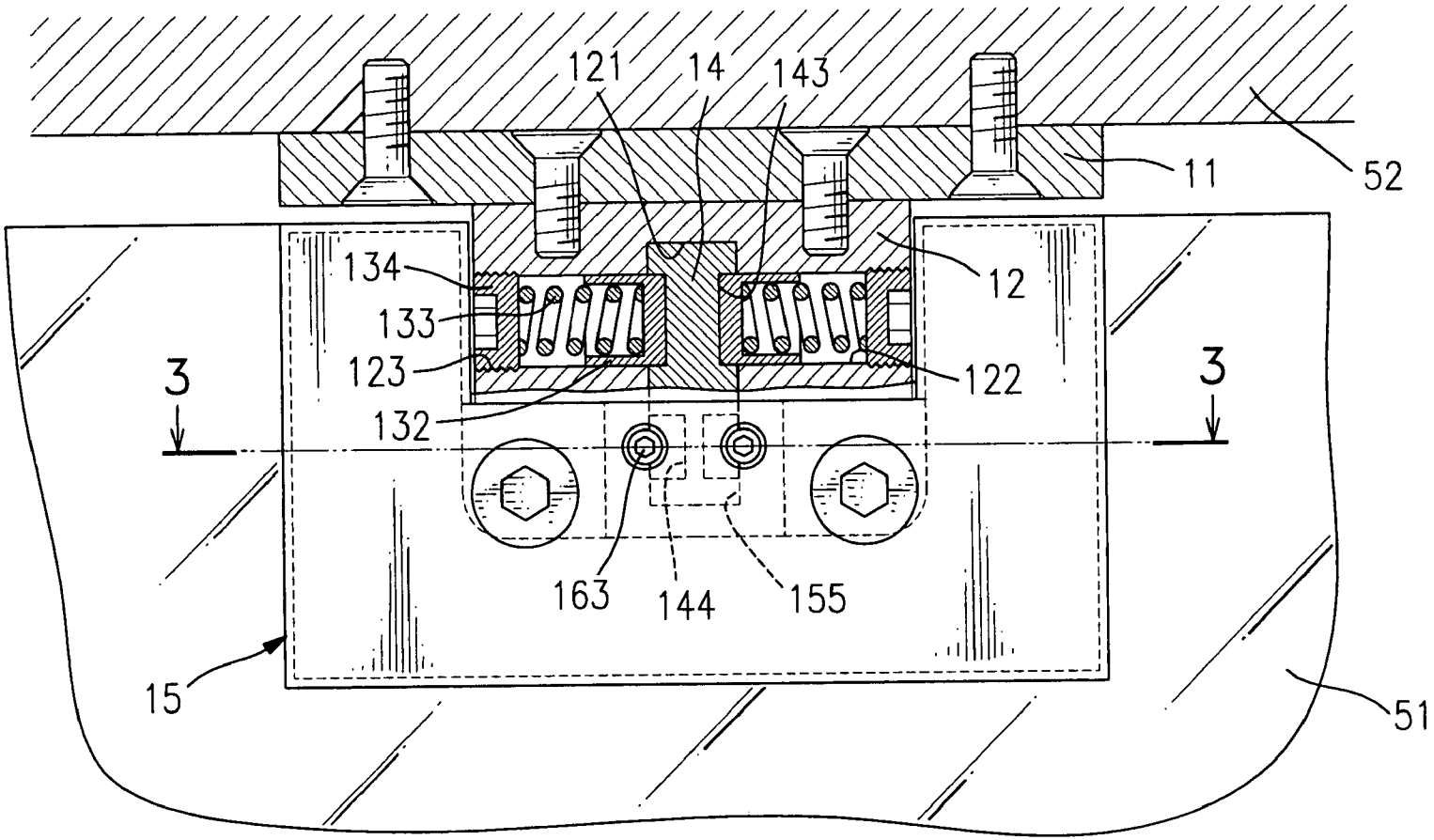
FIG. 3 is an operational front elevational view in partial section of the adjustable hinge in FIG. 2.

With further reference to FIG. 3, the spindle (14) is a cylinder and has an outer end (141), an inner end (142), an exterior surface (not numbered), two positioning flats (143) and two inclined adjusting flats (144). The outer end (141) is rotatably held in the spindle positioning hole (121) in the body (12). The positioning flats (143) are defined in the exterior surface and align respectively with the transverse holes (122). The inner end (142) is mounted rotatably in the door bracket (15). The inclined adjusting flats (144) are defined in the exterior surface of the spindle (14) and are mounted inside the door bracket (15).

The positioning device (13) comprises two activating assemblies (131) that are mounted and held respectively in the transverse holes (122). Each of the activating assemblies (131) comprises an inner cap (132), a resilient element (133) and a threaded plug (134). The inner caps (132) are slidably mounted respectively in the transverse holes (122) and abut respectively the positioning flats (143) on the spindle (14). The resilient element (133) can be a spring, is mounted in the transverse hole (122) and has two opposite ends (not numbered). The threaded plugs (134) screw respectively into the interior threads (123) in the transverse holes (122) and compress the resilient elements (133) against the inner caps (132) so the inner caps (132) firmly abut the positioning flats (143).

The door bracket (15) holds rotatably the inner end (142) of the spindle (14), connects to the glass panel (51) and comprises a male bracket (151) and a female bracket (152). The male bracket (151) and the female bracket (152) may be U-shaped and are attached to each other to form the door bracket (15) to hold the glass panel (51). The male bracket (151) has a primary protrusion (153) that extends toward the female bracket (152). The primary protrusion (153) has a secondary protrusion (154), a spindle alignment hole (155) and two threaded holes (156). The secondary protrusion (154) extends toward the female bracket (152). The spindle alignment hole (155) is aligned with the spindle positioning hole (121) in the body (12) and holds rotatably the inner end (142) of the spindle (14).

The inclined adjusting flats (144) on the spindle (14) are mounted in the spindle alignment hole (155). The threaded holes (156) are defined transversely through the primary and secondary protrusions (153, 154), communicate with the spindle alignment hole (155) and are aligned respectively with the inclined adjusting flats (144) on the spindle (14).

The female bracket (152) is attached to the male bracket (151) so the glass panel (51) will be held securely between the two brackets (151, 152). The female bracket (152) has a recess (157) and two through holes (158). The recess (157) holds and engages the secondary protrusion (154) and keeps the two brackets (151, 152) from moving relative to each other. The through holes (158) are aligned respectively with the threaded holes (156) in the male bracket (151).

The adjusting screws (16) screw respectively into the threaded holes (156) in the male bracket (151) through the through holes (158) in the female bracket (152). Each of the adjusting screws (16) has an inside end (161) and an outside end (162). The outside end (162) of each adjusting screw (16) has a hexagonal driving recess (163) so the adjusting screws (16) can be driven into or retracted from the threaded holes (156) with an Allen wrench (not shown). The inside ends (161) abut respectively the inclined adjusting flats (144) on the spindle (14).

With reference to FIGS. 1 and 3, the glass door (50) is closed and the glass panel (51) is held in a closed position by the inner caps (132) pressing respectively against the positioning flats (143). Pulling or pushing the glass panel (51) will open the glass door (50) and will pivot the glass panel (51) and the spindles (14) in the hinges (10). The inner caps (132) slide respectively out of full contact with the positioning flats (143) and compress the resilient elements (133). The compressed resilient elements (133) press the inner caps (132) that cause the spindle (14) to rotate until the inner caps (132) are in full contact with the positioning flats (143) again. When the inner caps (132) are in full contact with the positioning flats (143) the glass panel (51) is in the closed position so the positioning device (13) automatically closes the glass panel (51).

Figure 4:
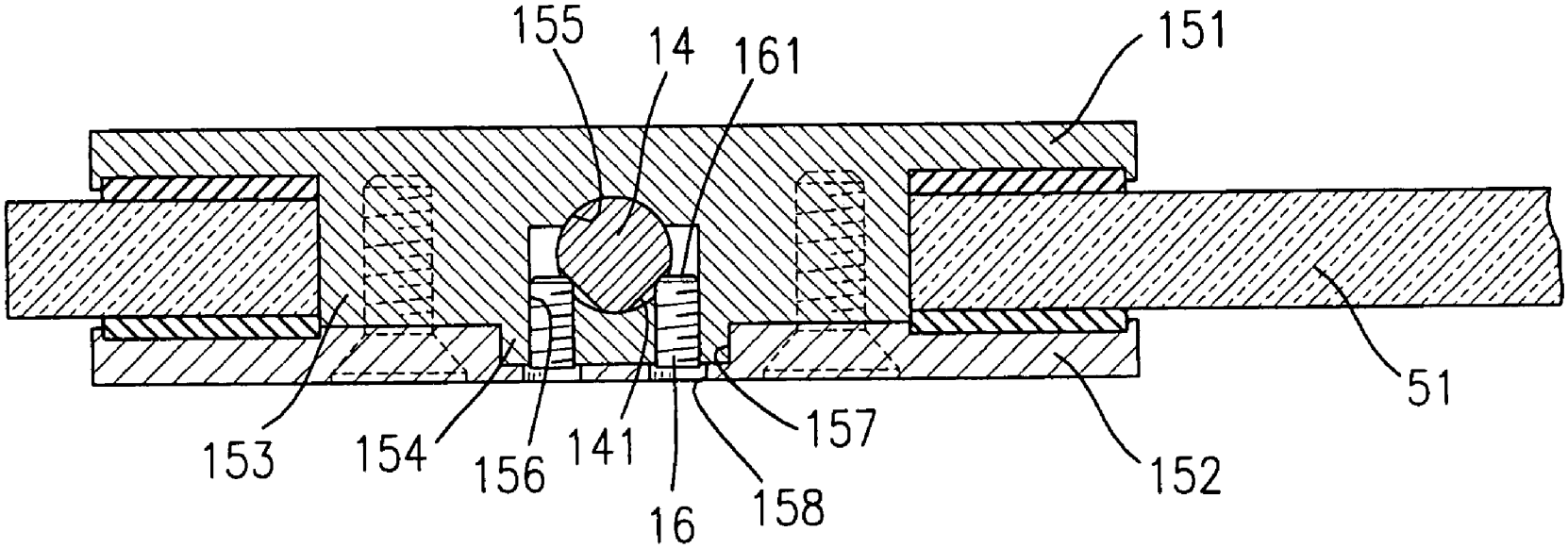
FIG. 4 is a top view in partial section of the adjustable hinge along 3—3 line in FIG. 3.
Figure 5:
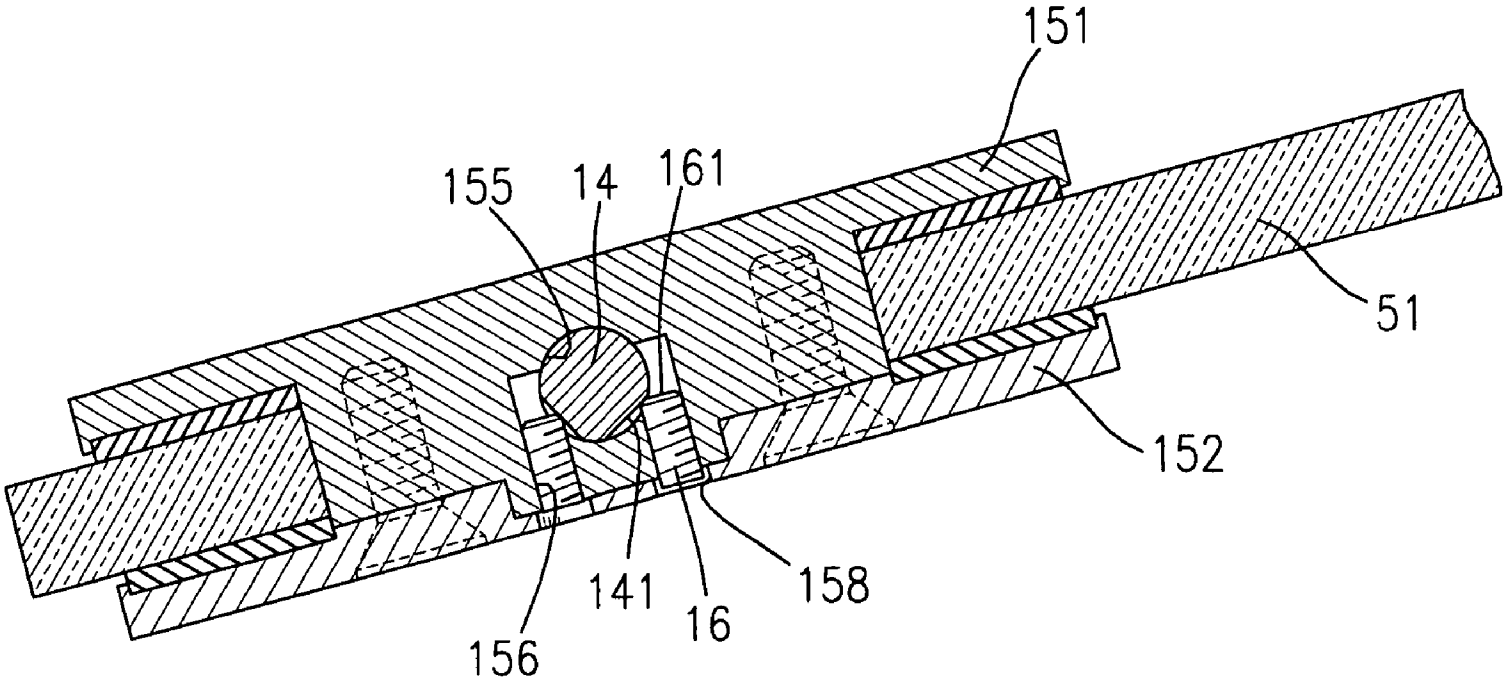
FIG. 5 is an operational top view in partial section of the adjustable hinge in FIG. 4 when a small adjustment is made to the glass panel of a glass door with the adjustable hinge.

With reference to FIGS. 1, 4 and 5, the adjusting screws (16) are used to deflect the closed position of the glass panel (51) relative to the doorframe (52) to align the glass panel (51) with the doorframe (52) when the glass panel (51) is not true. Screwing one of the adjusting screws (16) into one threaded hole (156) and backing the other adjusting screw (16) out of the other threaded hole (156) causes the inside ends (161) of the adjusting screws (16) that respectively abut the inclined adjusting flats (144) to change angular positions of the inclined adjusting flats (144). The closed position of the glass panel (51) can be adjusted any amount by changing angular positions of the inclined adjusting flats (144). Exact alignment of the glass panel (51) with the doorframe (52) can be accomplished by the adjusting screws (16).

Figure 7:
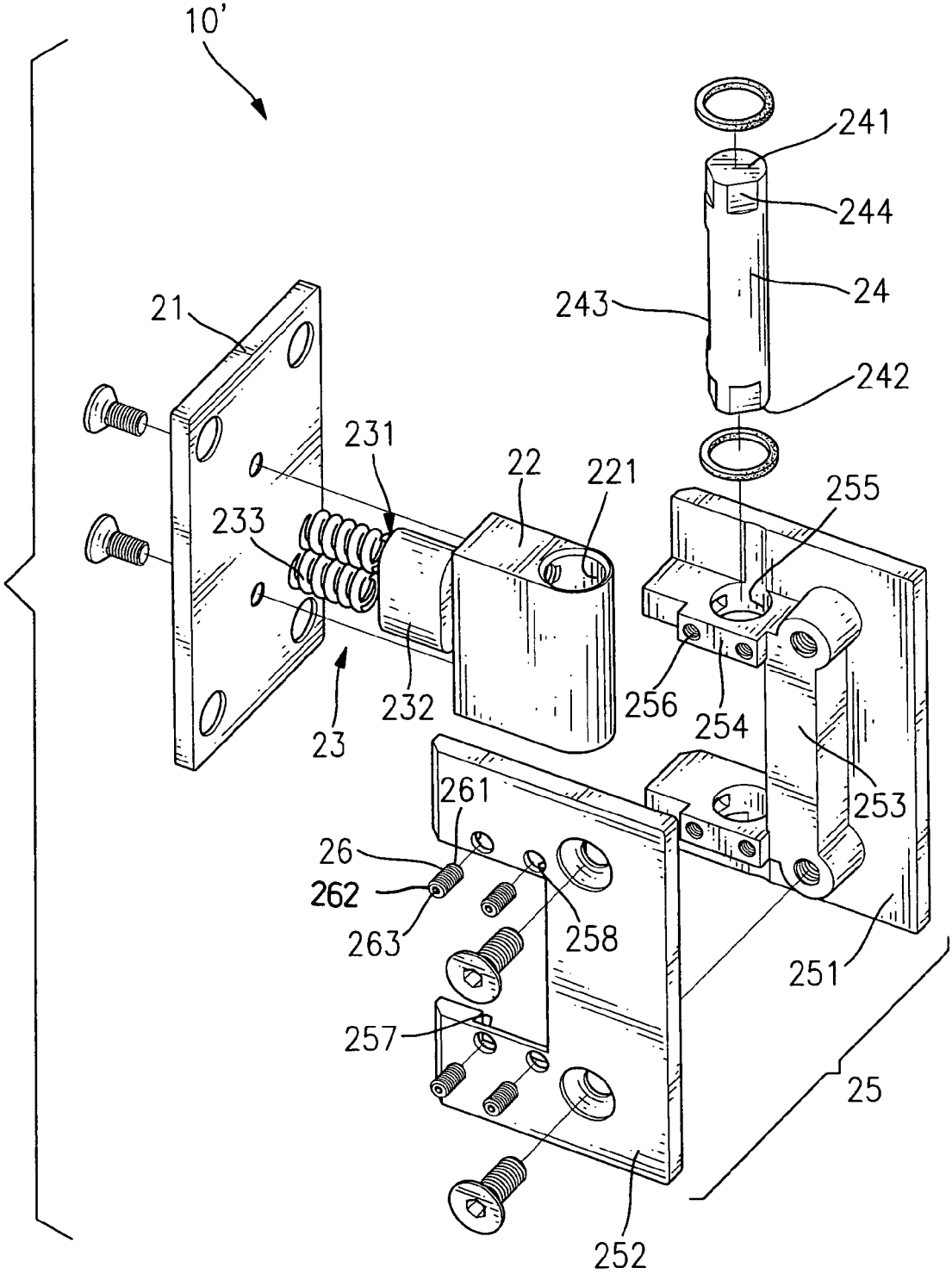
FIG. 7 is an exploded perspective view of one of the adjustable hinges in FIG. 6.

With reference to FIGS. 6 and 7, a second embodiment of an adjusting hinge (10') in accordance with the present invention pivotally attaches a glass panel (51) to a doorframe (52) by attaching two adjusting hinges (10') to one of the sides of the glass panel (51) and to the doorframe (52). The hinge (10') comprises a doorframe mount (21), a body (22), a positioning device (23), a spindle (24), a door bracket (25) and two pairs of adjusting screws (26).

Figure 8:
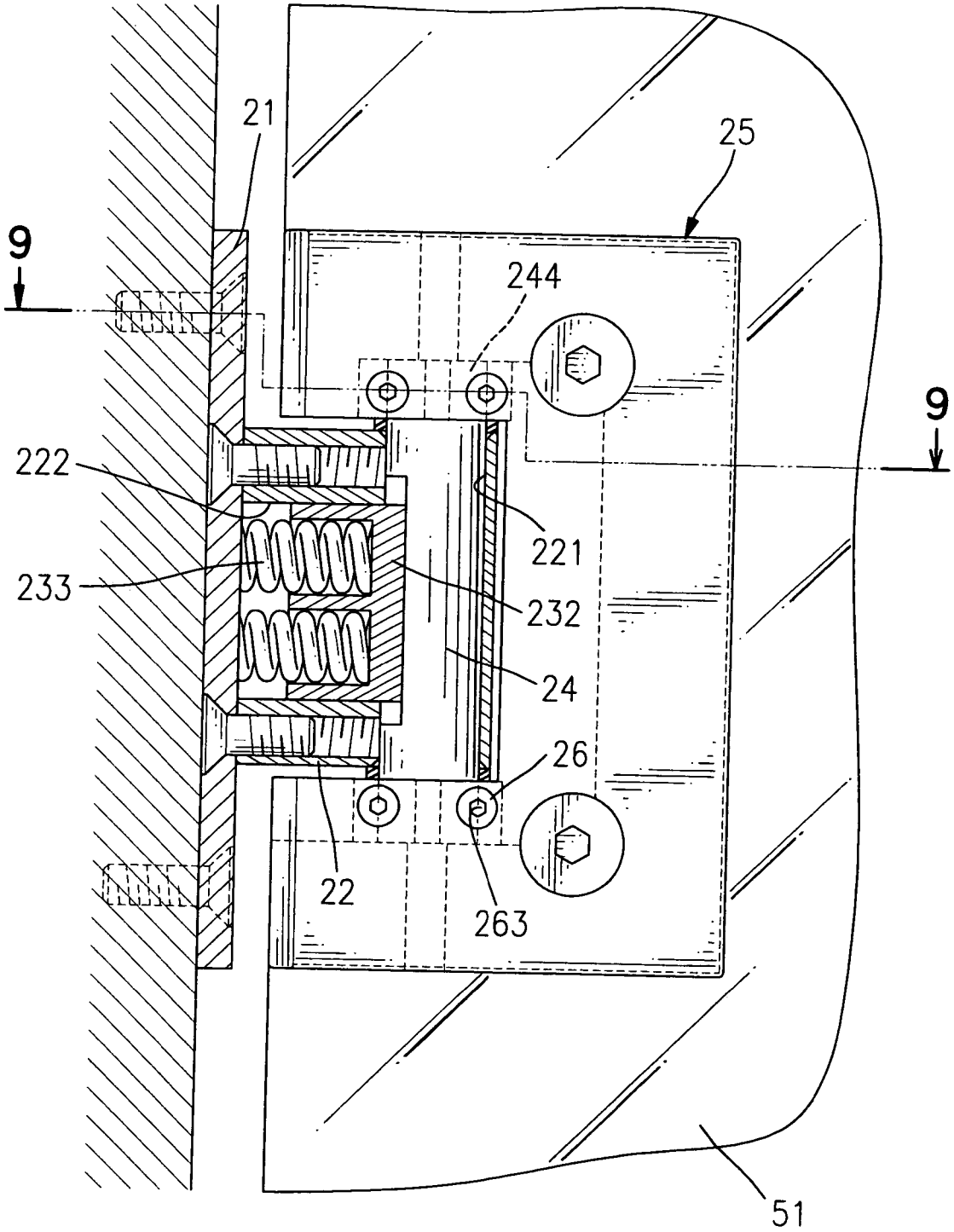
FIG. 8 is an operational front view in partial section of the adjustable hinge in FIG. 7.

With further reference to FIG. 8, the doorframe mount (21) attaches the hinge (10') to the doorframe (51). The body (22) is attached to the doorframe mount (21) and has a spindle positioning hole (221) and a transverse hole (222). The transverse hole (222) communicates with the spindle positioning hole (221) and faces the doorframe mount (21).

The spindle (24) is mounted rotatably in the spindle positioning hole (221) and has an exterior surface (not numbered), an upper end (241), a lower end (242), a positioning flat (243) and two pairs of inclined adjusting flats (244). The positioning flat (243) is defined in the exterior surface in the spindle positioning hole (221) and is aligned with the transverse hole (222). The upper and the lower ends (241, 242) extend respectively out of the spindle positioning hole (221) and are mounted rotatably in the door bracket (25). The pairs of inclined adjusting flats (244) are defined in the exterior surface respectively at the upper and the lower ends (241, 242) out of the spindle positioning hole (221).

The positioning device (23) is mounted in the body (22) and comprises an activating assembly (231). The activating assembly (231) comprises two resilient elements (233) and an inner cap (232). The inner cap (232) is mounted slidably in the transverse hole (222) and abuts the positioning flat (243) on the spindle (24). The resilient elements (233) can be springs, are mounted in the transverse hole (222) between the inner cap (232) and the doorframe mount (21) to push the inner cap (232) against the positioning flat (243).

The door bracket (25) is attached to the glass panel (51) and comprises a male bracket (251) and a female bracket (252). The male and the female brackets (251, 252) are U-shaped and are attached together to form the door bracket (25) to hold the glass panel (51). The male bracket (251) has a U-shaped primary protrusion (253) that extends toward the female bracket (252). The primary protrusion (253) has two secondary protrusions (254) that extend toward the female bracket (252), two spindle alignment holes (255) and two pairs of threaded holes (256). The secondary protrusions (254) correspond respectively to the upper and the lower ends (241, 242) of the spindle (24). The spindle alignment holes (255) align with the spindle positioning hole (221) in the body (22) and rotatably hold respectively the upper and the lower ends (241, 242) of the spindle (24).

The pairs of inclined adjusting flats (244) are defined respectively at the upper and the lower ends (241, 242) on the spindle (24) and align with the spindle alignment holes (255). The pairs of threaded holes (256) are respectively defined completely through the secondary protrusions (254), communicate respectively with the corresponding spindle alignment holes (255) and are aligned respectively with the inclined adjusting flats (244) on the spindle (24).

The female bracket (252) is attached to the male bracket (251), and the glass panel (51) is held between the two brackets (251, 252). The female bracket (252) has two recesses (257) and two pairs of through holes (258). The recesses (257) hold and engage respectively the secondary protrusions (254) to keep the two brackets (251, 252) from moving relative to each other. The pairs of through holes (258) are aligned respectively with the pairs of threaded holes (256) in the male bracket (251).

The adjusting screws (26) extend respectively through the through holes (258) in the female bracket (252) and screw respectively into the threaded holes (256) in the male bracket (251). Each of the adjusting screws (26) has an inside end (261) and an outside end (262). The outside end (262) of each adjusting screw (26) can have a hexagonal driving recess (263) so that the adjusting screws (26) can be driven into or retracted from the threaded holes (256) with an Allen wrench (not shown). The inside ends (261) abut respectively the inclined adjusting flats (244) on the spindle (24).

Figure 9:
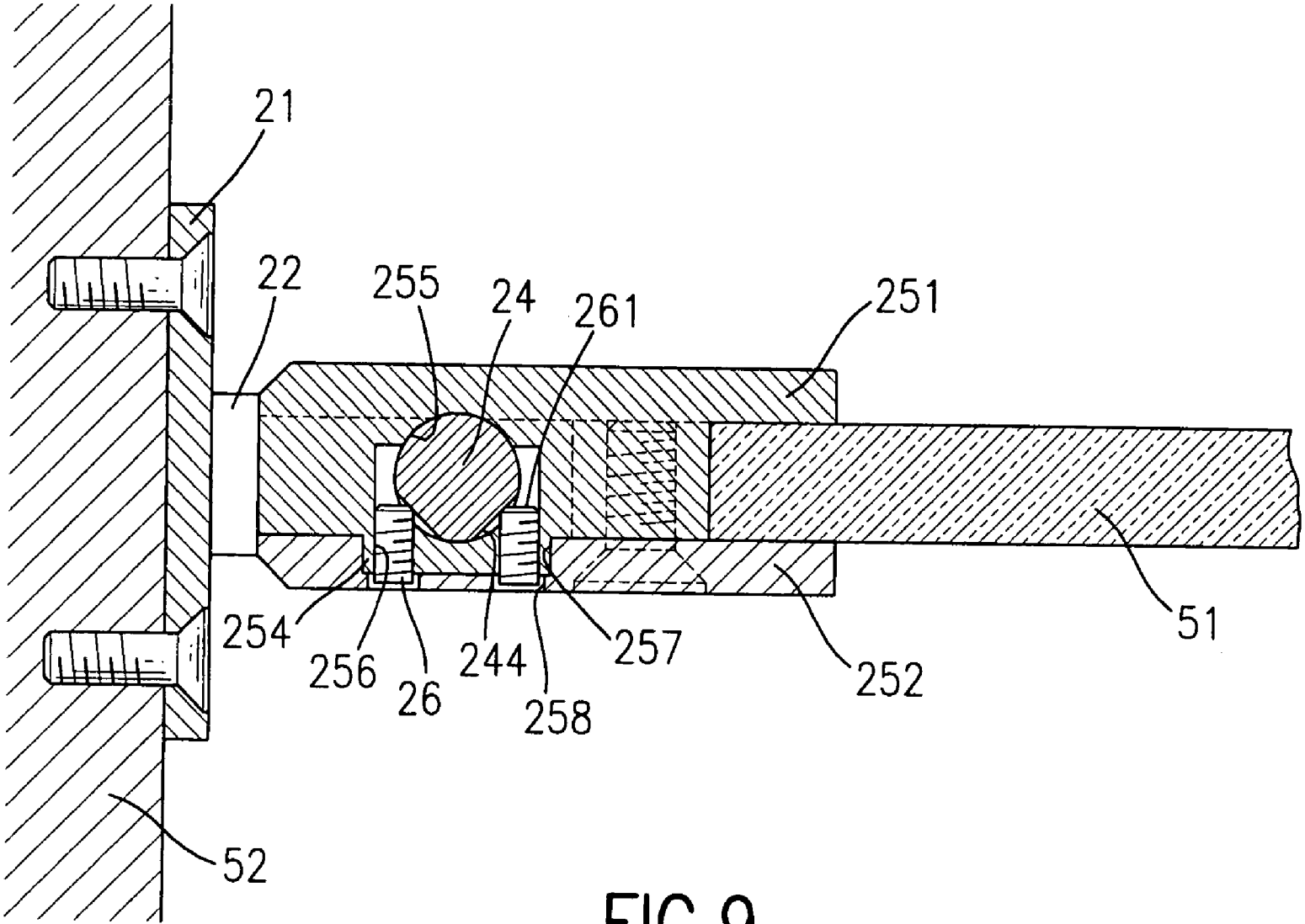
FIG. 9 is a top view in partial section of the adjustable hinge along 9—9 line in FIG. 8.
Figure 10:
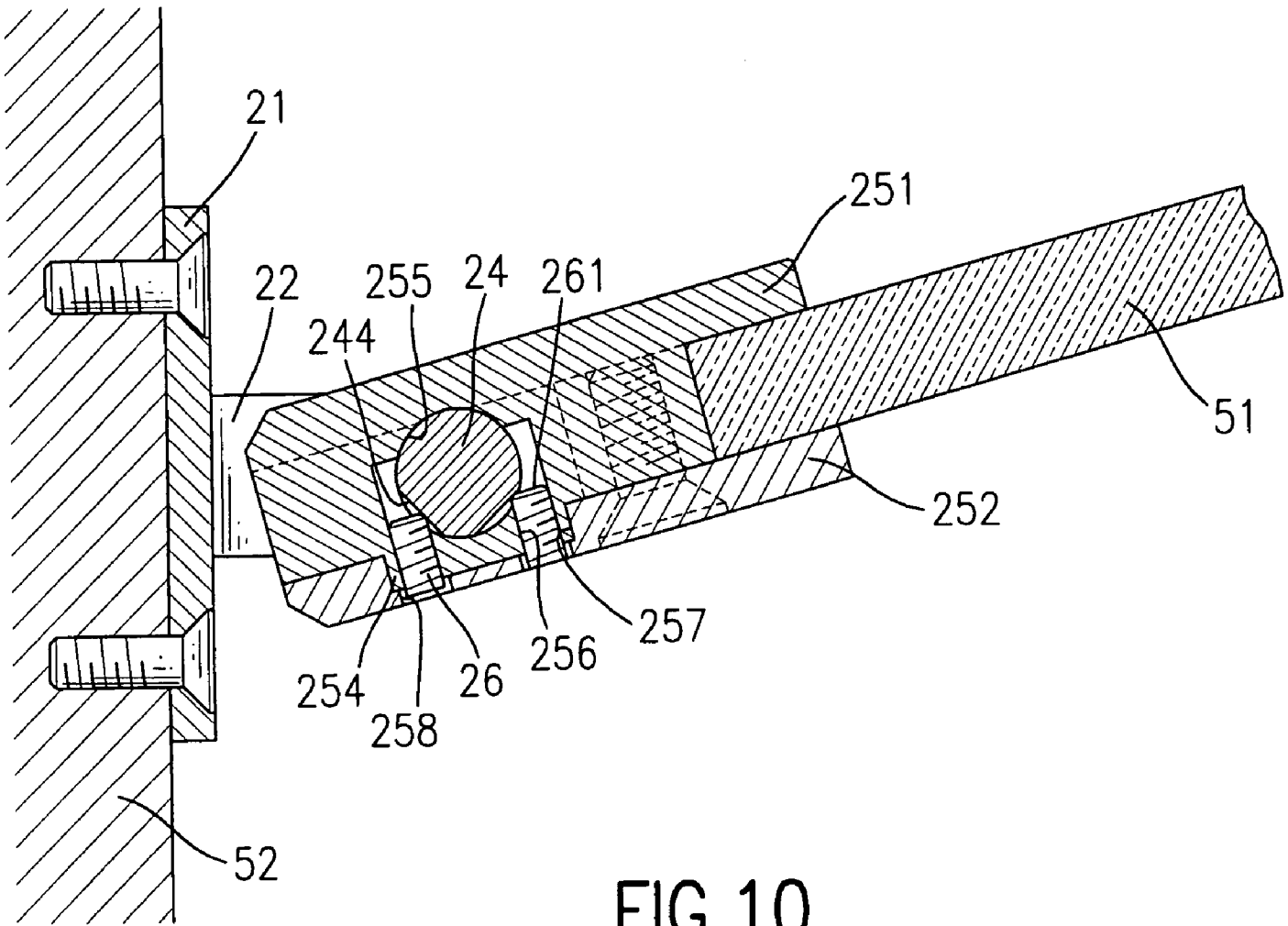
FIG. 10 is an operational top view in partial section of the adjustable hinge in FIG. 9 when a small adjustment is made to the glass panel of the glass door with the adjustable hinge.

With reference to FIGS. 6, 9 and 10, a detailed description of the operation of the second embodiment of the hinge (10') in accordance with the present invention is not provided since the operation of the hinge (10') is similar to the operation of the first embodiment.

The glass panel (51) does not have to be detached from the hinges (10, 10') to adjust the glass panel (51). Therefore, aligning the glass panel (51) with the doorframe (52) by screwing the adjusting screws (16, 26) is convenient, quick and simple. In addition the glass panel (51) can be adjusted to any angle relative to the doorframe (52) when the glass panel (51) is not true. Therefore, exactly aligning the glass panel (51) with the doorframe (52) is easy to accomplish.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. An adjustable automatic positioning hinge for a glass door and the adjustable hinge comprising:

a doorframe mount;

a body attached to the doorframe mount and having a spindle positioning hole;

a spindle mounted rotatably in the spindle positioning hole and having an exterior surface and two inclined adjusting flats defined in the exterior surface;

a positioning device mounted in the body to position the spindle in the spindle positioning hole;

a door bracket in which the spindle is rotatably mounted, the door bracket comprising a male bracket having two threaded holes aligned respectively with the inclined adjusting flats on the spindle; and a female bracket attached to the male bracket and having two through holes aligned respectively with the threaded holes in the male bracket;

two adjusting screws passing respectively through the through holes in the female bracket, screwing respectively into and held respectively in the threaded holes in the male bracket and having inside ends respectively abutting the inclined adjusting flats on the spindle.

2. The adjustable automatic positioning hinge as claimed as claimed in claim 1, wherein the body further has two transverse holes defined coaxially with each other alongside and communicating with the spindle positioning hole, each of the transverse holes has an outer opening and an interior thread formed in the opening;

the spindle further has two positioning flats aligned respectively with the transverse holes in the body; and the positioning device comprises two activating assemblies mounted respectively in the transverse holes, and each of the activating assemblies comprises an inner cap abutting a corresponding one of the positioning flats, a threaded plug screwed into the interior thread in the respective transverse hole and a resilient element mounted between the threaded plug and the inner cap to press the inner cap against the corresponding positioning flat.

3. The adjustable automatic positioning hinge as claimed in claim 2, wherein the resilient elements are springs.

4. The adjustable automatic positioning hinge as claimed in claim 3, wherein the male bracket further has a secondary protrusion protruding from the primary protrusion toward the female bracket;

the threaded holes are defined completely through the secondary protrusion and align respectively with the inclined adjusting flats; and the female bracket further has a recess holding and engaging the secondary protrusion.

5. The adjustable automatic positioning hinge as claimed in claim 4, wherein each of the adjusting screws further has an outside end and a hexagonal driving recess defined at the outside end.

6. The adjustable automatic positioning hinge as claimed in claim 5, wherein both the male and the female brackets are U-shaped.

7. The adjustable automatic positioning hinge as claimed in claim 1, wherein the male bracket further has a primary protrusion extending toward the female bracket, and the primary protrusion has a spindle alignment hole aligned coaxially with the spindle positioning hole;

the spindle further has an outer end rotatably mounted in the spindle positioning hole and an inner end securely mounted in the spindle alignment hole; and the inclined adjusting flats are defined in the exterior surface of the spindle and are mounted in the spindle alignment hole.

8. The adjustable automatic positioning hinge as claimed as claimed in claim 1, wherein the body further has a transverse hole defined and communicating with the spindle positioning hole and facing the doorframe mount;

the spindle further has a positioning flat aligned with the transverse hole in the body; and the positioning device comprises an activating assembly mounted in the transverse hole, and the activating assembly comprises an inner cap abutting the positioning flat and a resilient element mounted between the doorframe mount and the inner cap to press the inner cap against the positioning flat.

9. The adjustable automatic positioning hinge as claimed in claim 8, wherein the male bracket further has a U-shaped primary protrusion extending toward the female bracket, and the primary protrusion has two spindle alignment holes aligned coaxially with the spindle positioning hole;

the spindle further has an upper end and a lower end extending out of the spindle positioning hole and rotatably held respectively in the spindle alignment holes; and the inclined adjusting flats are defined in the exterior surface at the upper end of the spindle.

10. The adjustable automatic positioning hinge as claimed in claim 9, wherein the male bracket further has two secondary protrusions corresponding respectively to the spindle alignment holes and protruding respectively from the primary protrusion toward the female bracket;

the threaded holes are defined completely through one of the secondary protrusions to align respectively with the inclined adjusting flats; and the female bracket further has two recesses respectively holding and engaging the secondary protrusions.

11. The adjustable automatic positioning hinge as claimed in claim 10, wherein the spindle further has two inclined adjusting flats defined in the exterior surface at the lower end of the spindle;

the male bracket further has two threaded holes defined completely through one of the secondary protrusions to align respectively with the inclined adjusting flats at the lower end of the spindle;

the female bracket further has two through holes aligned respectively with the threaded holes and the inclined adjusting flats at the lower end of the spindle; and the adjustable automatic positioning hinge further comprises two adjusting screws screwing respectively into and held respectively in the threaded holes aligned respectively with the inclined adjusting flats at the lower end of the spindle and each of the adjusting screws in the threaded holes aligned respectively with a respective one of the inclined adjusting flats at the lower end of the spindle has an inner end abutting the aligned inclined adjusting flat.

12. The adjustable automatic positioning hinge as claimed in claim 11, wherein each of the adjusting screw further has an outside end and a hexagonal drive recess defined at the outside end.

13. The adjustable automatic positioning hinge as claimed in claim 12, wherein both the male and the female brackets are U-shaped.

14. The adjustable automatic positioning hinge as claimed in claim 13, wherein the resilient element is spring.

* * * * *